US007497080B2

(12) United States Patent
Ueda

(10) Patent No.: US 7,497,080 B2
(45) Date of Patent: Mar. 3, 2009

(54) HYDRAULIC CONTROLLING DEVICE OF WORKING MACHINE

(75) Inventor: Koji Ueda, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 222 days.

(21) Appl. No.: 11/623,491

(22) Filed: Jan. 16, 2007

(65) Prior Publication Data

US 2007/0193261 A1 Aug. 23, 2007

(30) Foreign Application Priority Data

Feb. 20, 2006 (JP) ..... 2006-042209

(51) Int. Cl.
*F16D 31/02* (2006.01)

(52) U.S. Cl. ..... 60/421; 60/429

(58) Field of Classification Search ..... 60/421, 60/428, 429, 484, 486
See application file for complete search history.

(56) References Cited

U.S. PATENT DOCUMENTS 5,052,179 A * 10/1991 Fujii ..... 60/421
5,568,727 A * 10/1996 Chung ..... 60/421
5,680,759 A * 10/1997 Chung ..... 60/421
5,692,377 A * 12/1997 Moriya et al. ..... 60/421
6,148,548 A 11/2000 Tohji
6,851,207 B2 * 2/2005 Yoshimatsu ..... 60/420
2006/0265915 A1 11/2006 Toji et al.

FOREIGN PATENT DOCUMENTS

| | | |
|---|---|---|
| EP | 0 722 018 A1 | 7/1996 |
| EP | 1 022 395 A1 | 7/2000 |
| JP | 61-031535 | 2/1986 |
| JP | 2000-17693 | 1/2000 |

* cited by examiner

*Primary Examiner*—Michael Leslie
(74) *Attorney, Agent, or Firm*—Oblon, Spivak, McClelland, Maier & Neustadt, P.C.

(57) ABSTRACT

A hydraulic controlling device in which, when performing a combined operational process, a position of a straight travel valve is switched to a straight travel position to drive both a travel motor and a working actuator by separate pumps. In this case, to prevent a sudden reduction in travel speed resulting from a reduction in a flow amount at a travel side, pump lines of both pumps are connected to each other at an intermediate position by a connection path, so that a portion of oil at a working side is sent towards the travel side. With such a structure, when a rotational speed of an engine is less than a set rotational speed, an opening amount of the connection path is reduced through a straight travel proportional valve by a controller, thereby preventing pressure interference causing, for example, the working actuator to no longer move.

4 Claims, 5 Drawing Sheets

HYDRAULIC CONTROLLING DEVICE OF WORKING MACHINE

BACKGROUND OF THE INVENTION

1. Field of the Invention

The present invention relates to a hydraulic controlling device of a working machine such as a hydraulic excavator.

2. Description of the Related Art

A related art will be described taking a hydraulic excavator as an example.

As shown in FIG. 5, in the hydraulic excavator, an upper rotating body 2 is mounted on a crawler-type lower traveling body 1 so as to be rotatable around a vertical axis. In addition, in the hydraulic excavator, a working (excavating) attachment 9 including a boom 3, an arm 4, a bucket 5, and cylinders 6, 7, and 8 for raising and lowering the boom, operating the arm, and operating the bucket, respectively, is mounted on the upper rotating body 2.

Left and right travel motors 10 and 11 that travel-drive the lower traveling body 1 and a rotation motor 12 that rotationally drives the upper rotating body 2 are provided (see FIG. 6).

FIG. 6 shows the entire structure of a hydraulic controlling device of the hydraulic excavator.

Hydraulic actuator groups are divided into a first group G1 and a second group G2. The first group G1 includes the right travel motor 11, the bucket cylinder 8, and the boom cylinder 6. The second group G2 includes the left travel motor 10, the rotation motor 12, and the arm cylinder 7.

With the travel motor 11 being defined as the uppermost stream side, the hydraulic actuators of the group G1 are connected in tandem with each other by a center bypass line CB1. Similarly, with the travel motor 10 being defined as the uppermost stream side, the hydraulic actuators of the group G2 are connected in tandem with each other by a center bypass line CB2. The hydraulic actuators other than the travel motors (hereunder referred to as the "working actuators"), that is, the hydraulic actuators 6, 7, 8 and 12 are connected parallel to oil pressure supply pipelines L1 and L2 that are provided separately from the center bypass lines CB1 and CB2. Reference characters T refer to tanks.

Hydraulic pilot control valves 13 to 18 for controlling the operations of the hydraulic actuators and remote control valves (not shown), serving as operating means for performing switching operations, are provided at the respective hydraulic actuators.

First and second pumps 19 and 20, serving as oil pressure supply sources for the hydraulic actuator groups, are provided. Oil discharged from the pump 19 and oil discharged from the pump 20 are supplied to the groups G1 and G2 through a hydraulic pilot straight travel valve 21.

The straight travel valve 21 is formed as a two-position, four-port switching valve having a neutral position X and a straight travel position Y that provide functions and having two pump ports P1 and P2 and two actuator ports a and b. The straight travel valve 21 is subjected to switching control by secondary pressure of a straight travel proportional valve 23, which is an electromagnetic proportional valve, based on a command from a controller 22.

Operation signals in accordance with operation amounts of the respective remote control valves (such as signals from pressure sensors that detect secondary pressures of the remote control valves) are input to the controller 22. When performing a single operational process in which a travel operation and working operation (operation of the working actuators 6, 7, 8, and 12) are performed separately, the straight travel valve 21 is at the illustrated neutral position X.

In this state, oil discharged from the first pump 19 flows through a path extending from P1 to b of the straight travel valve 21 and reaches the first group G1, and oil discharged from the second pump 20 is supplied directly to the second group G2. (This state will hereunder be called "first oil pressure supply state.")

In a combined operational process in which the travel operation and the working operation are carried out at the same time, the neutral position X of the straight travel valve 21 is switched to the straight travel position Y.

In this state, the oil discharged from the first pump 19 flows through the oil pressure supply pipeline L1, and flows from a path extending from P1 to a of the straight travel valve 21 to the oil pressure supply pipeline L1 to be supplied to the hydraulic actuators 6, 7, 8, and 12 (which are the hydraulic actuators other than the travel motors 10 and 11). The oil discharged from the second pump 20 is distributed and supplied to the travel motors 10 and 11. (This state will hereunder be called "second oil pressure supply state.")

Since, in the second oil pressure supply state, both of the motors 10 and 11 are driven by the common second pump 20, if they are travel-operated by the same amount, the same amount of oil is supplied to the travel motors 10 and 11, so that they rotate at the same speed. That is, straight travel ability is ensured.

In this case, since the amount of oil pressure supplied to the travel motors 10 and 11 becomes half that in the first oil pressure supply state, the speed is also halved (that is, is suddenly reduced). Therefore, a shock is generated.

To overcome this problem, a connection path 24, serving as means for reducing shock, is provided in the straight travel valve 21. When, in the second oil pressure supply state, pump lines of the pumps 19 and 20 are connected to each other by the connection path 24, a portion of the oil discharged from the first pump 19 is sent to a travel side (refer to Japanese Unexamined Patent Application Publication No. 2000-17693).

It is known that, when a controlling device has a structure in which a plurality of actuators are driven by a common pump, pressure interference that makes it difficult for oil to flow towards high operating pressure occurs.

According to this structure, in general, the amount of opening of the connection path 24 is fixed, and the amount of oil flowing through the connection path 24 is determined by a pump discharge amount and an operating pressure of each actuator.

In this case, if the pump discharge amount is sufficiently large, no conspicuous problems arise. However, when the rotational speed of an engine is low as during low idling, the pump discharge amount is small, thereby considerably reducing the amount of oil that is supplied to each actuator. Therefore, when carrying out a combined operational process in a state in which the engine is rotating at a low speed, the influence of the pressure interference is increased. As a result, work, such as raising a boom, requiring a load (operating pressure) that is higher than that required for traveling is improperly performed, that is, movement becomes extremely slow or no longer occurs).

Japanese Unexamined Patent Application Publication No. 2000-17693 discloses a technology in which the connection path is narrowed when the discharge pressures of the two pumps that are detected become equal to or greater than a certain value. However, this technology aims at preventing pressure interference that occurs due to a difference between the discharge pressures of the pumps. Therefore, the technology cannot be used to directly overcome pressure interference that occurs due to a change in the rotational speed of the engine.

SUMMARY OF THE INVENTION

Accordingly, it is an object of the present invention to provide a hydraulic controlling device of a working machine that can reliably prevent pressure interference (improper operation of actuators) occurring when carrying out a combined operational process and caused by a reduction in the rotational speed of an engine.

The hydraulic controlling device of the working machine according to the present invention has the following basic structure.

The hydraulic controlling device of the working machine comprises a lower traveling body, an upper rotating body mounted on the lower traveling body, a working attachment mounted to the upper rotating body, and hydraulic actuator groups including left and right travel motors and working actuators that are actuators other than the left and right travel motors. The hydraulic actuator groups are divided into a first group and a second group, the first group including one of the left and right travel motors and the second group including the other of the left and right travel motors. The hydraulic controlling device also comprises first and second pumps serving as hydraulic sources that are driven by an engine, and a straight travel valve adapted to switch flow paths of oil discharged from the pumps. When performing a single operational process in which a travel operation and a working operation, which is an operation other than the travel operation, are performed separately, the straight travel valve is at a neutral position and supplies the oil discharged from the separate pumps to the first and second groups. When performing a combined operational process in which the travel operation and the working operation are performed at the same time, the position of the straight travel valve is switched to a straight travel position and the straight travel valve supplies the oil discharged from the separate pumps to both of the travel motors and the working actuators. When the neutral position of the straight travel valve is switched to the straight travel position, pump lines of both of the pumps are connected to each other by a connection path. In the invention of the application, the hydraulic controlling device further comprises controlling means for performing an opening controlling operation that reduces an opening amount of the connection path at a low-rotational-speed side in accordance with a rotational speed of the engine when performing the combined operational process.

According to the present invention, the hydraulic controlling device is formed so as to perform an opening controlling operation in which the opening amount of the connection path connecting the pump lines of the respective pumps with each other is reduced at the low-rotational-speed side in accordance with the rotational speed of the engine. Therefore, it is possible to reliably prevent pressure interference (which causes work such as raising a boom to be performed very slowly or which prevents such work from being performed) from occurring when performing a combined operational process in a state in which the rotational speed of the engine is low.

In this structure, it is desirable to provide a connection path in the straight travel valve. More specifically, the straight travel valve has an intermediate position that is disposed in the connection path and that is situated between the neutral position and the straight travel position, and the controlling means performs the opening controlling operation by controlling the position of the straight travel valve.

In this case, since the opening amount of the connection path of the straight travel valve itself is controlled by controlling the position of the straight travel valve, compared to, for example, a structure in which an opening of an externally provided communication valve is controlled, costs are reduced and less space is used.

In this structure, it is desirable that the hydraulic controlling device further comprise a communication valve that is disposed outside the straight travel valve, and that the controlling means perform the opening controlling operation with the communication valve serving as the connection path.

In this structure, it is desirable that the controlling means perform the opening controlling operation when the rotational speed of the engine is less than a set rotational speed.

In this case, since the opening is controlled when the rotational speed of the engine becomes less than a set rotational speed, if the set rotational speed is set at a rotational speed value at which pressure interference (improper operation of the working actuators) starts to occur when performing a combined operational process, it is possible to ensure its primary function (smooth travel) due to the provision of the connection path, at a rotational speed that is equal to or greater than the set rotational speed.

DESCRIPTION OF THE PREFERRED EMBODIMENTS

Figure 1:
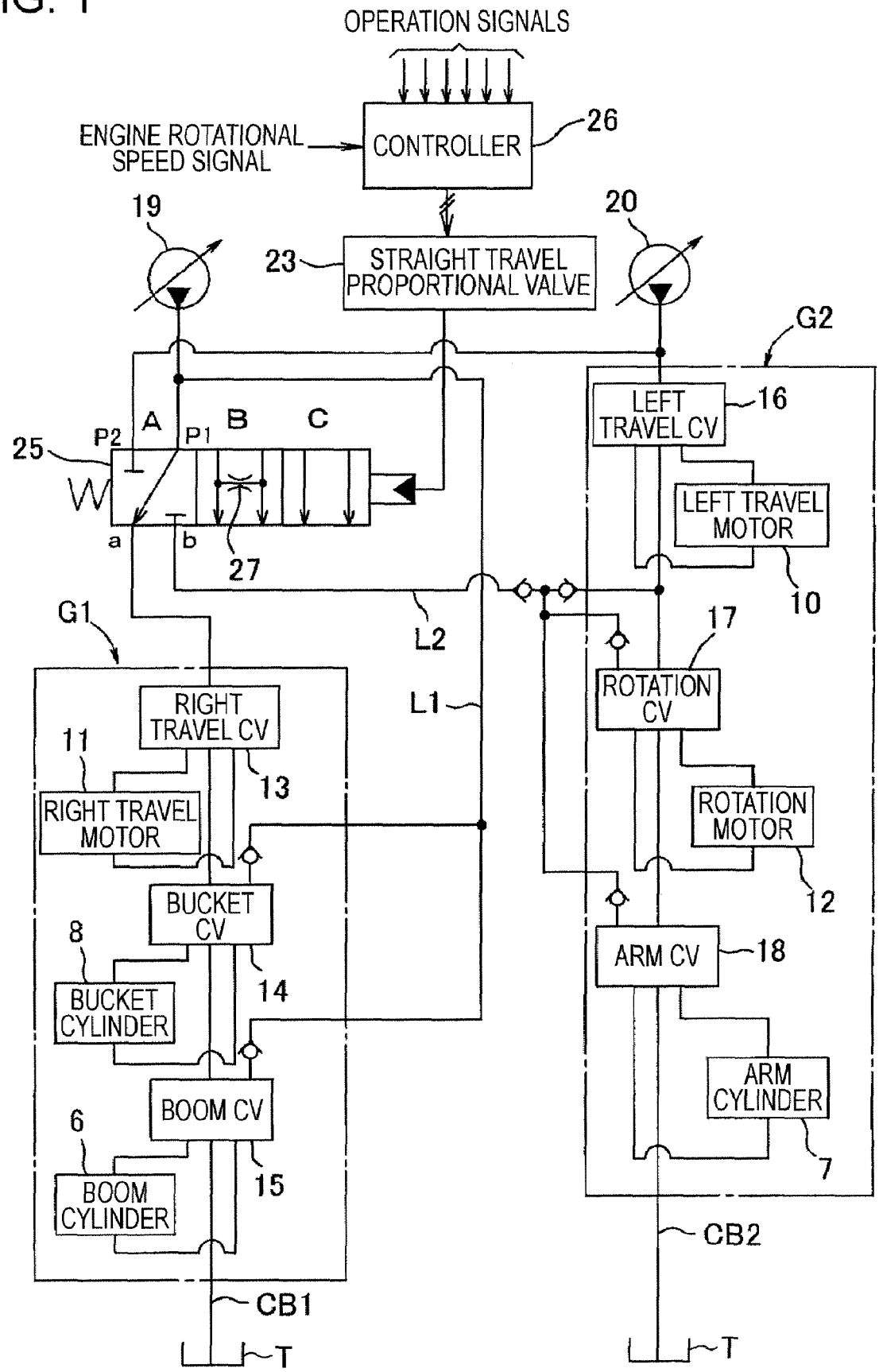
FIG. 1 shows an entire structure of a hydraulic controlling device according to an embodiment of the present invention.
Figure 6:
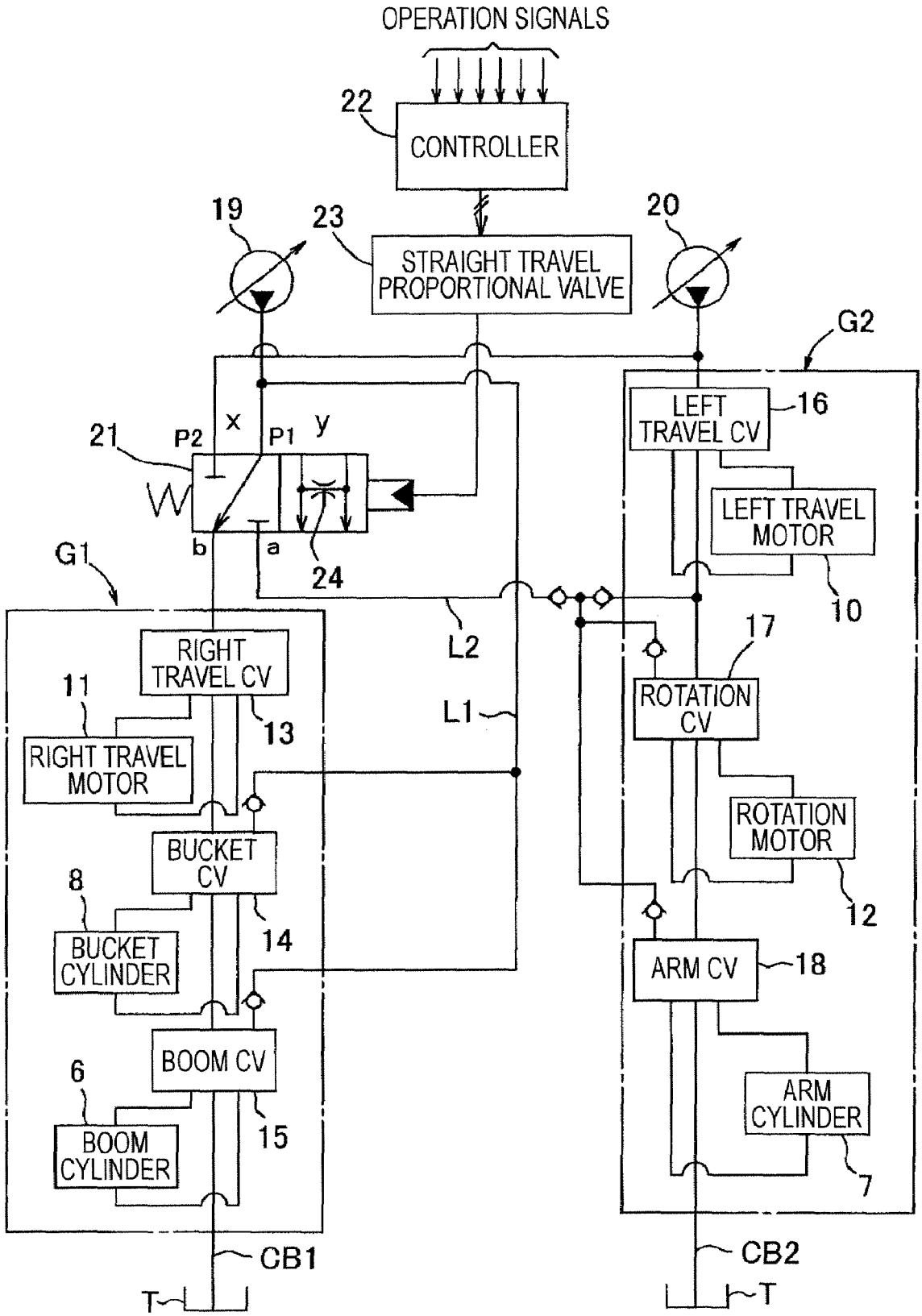
FIG. 6 shows an entire structure of a related hydraulic controlling device.

In FIG. 1 showing an embodiment, parts corresponding to those of the related hydraulic controlling device shown in FIG. 6 are given the same reference numerals and the same description of the corresponding parts will be omitted.

The embodiment shown in FIG. 1 is the same as the related device shown in FIG. 6 in that:

(i) groups of hydraulic actuators are divided into a first group G1 (including a right travel motor 11, a bucket cylinder 8, and a boom cylinder 6) and a second group G2 (including a left travel motor 10, a rotation motor 12, and an arm cylinder 7), and oil discharged from a first pump 19 and oil discharged from a second pump 20 are supplied to the groups G1 and G2 through a straight travel valve 25; and (ii) a straight travel proportional valve 23 is controlled on the basis of control signals from a controller 26 to control the straight travel valve 25 by a straight travel proportional valve 23.

The straight travel valve 25 has a neutral position A and a straight travel position C, and has two pump ports P1 and P2 and two actuator ports a and b. Operation signals in accordance with operation amounts of respective remote control valves are input to the controller 22. In a single operational process in which a travel operation and a working operation are performed separately, the straight travel valve 25 is at the illustrated neutral position A.

At the neutral position A, the first group G1 is driven by the first pump 19, and the second group G2 is driven by the second pump 20, so that a first oil pressure supply state results.

When the neutral position A is switched to the straight travel position C that is occupied when carrying out a combined operational process in which the travel operation and the working operation are carried out at the same time, the working actuators 6, 7, 8, and 12 are driven by the first pump 19 and the travel motors 10 and 11 are driven by the second pump 20, so that a second oil pressure supply state results.

In the straight travel valve 25, an intermediate position B is provided between the neutral position A and the straight travel position C, and a connection path 27 that connects both pump lines at the intermediate position B is provided. When the combined operational process is performed, the pump lines of the respective pumps 19 and 20 are connected to each other by the connection path 27.

In this state, a portion of the oil that is discharged from the first pump 19 is sent to a travel side to prevent a sudden reduction in a travel speed when the combined operational process is started.

In addition to the operation signals, a signal from a rotational-speed sensor (not shown) that detects the rotational speed of an engine, that is, an engine rotational-speed signal is input to the controller 26 to control an opening amount of the connection path 27 in accordance with the rotational speed of the engine when performing the combined operational process.

Figure 2:
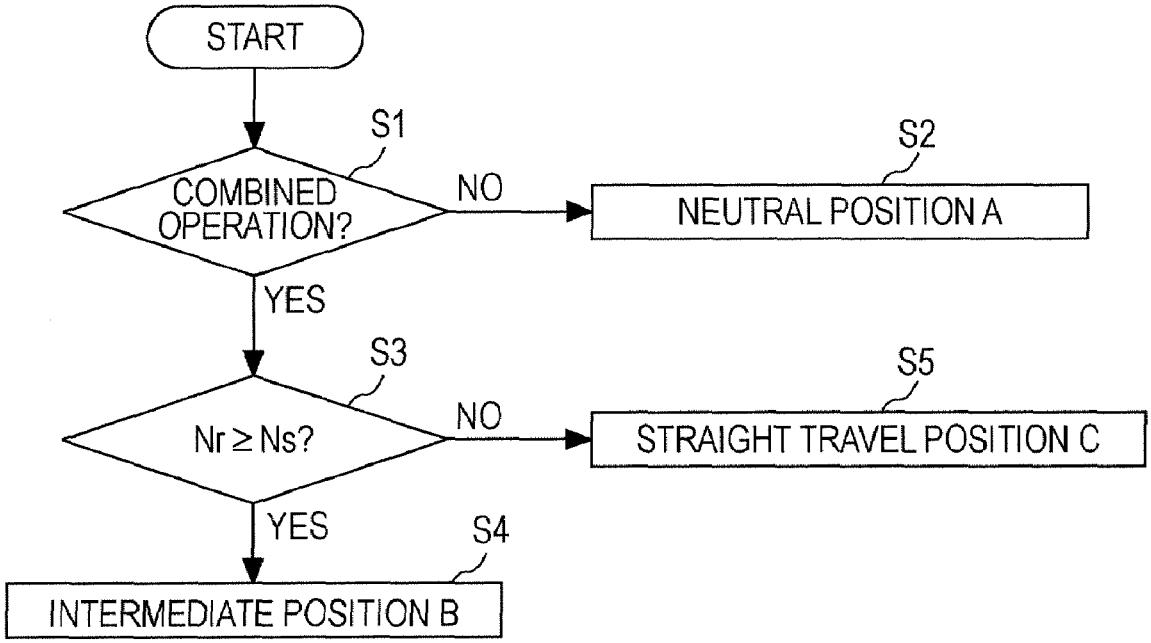
FIG. 2 is a flowchart for illustrating operations of the hydraulic controlling device.

The steps of the controlling operation will be described with reference to the flowchart of FIG. 2.

In Step S1, a determination is made as to whether or not a combined operational process is to be performed, on the basis of the operation signals. If it is not to be performed (that is, if a single operational process is to be performed), the process proceeds to Step S2 in which the straight travel valve 25 is set to its neutral position A, resulting in the first oil pressure supply state.

In contrast, if the combined operational process is to be performed in Step S1, an engine rotational speed Nr at this time and a previously set engine rotational speed (set engine rotational speed) Ns are compared with each other.

The set engine rotational speed Ns is a lower limit of the engine rotational speed at which the problem of pressure interference actually does not occur because the discharge amounts of the pumps 19 and 20 are sufficiently high. That is, the set engine rotational speed Ns is set as a rotational speed at which pressure interference occurs when the rotational speed becomes equal to or less than the lower limit. In Step S3, if $Nr \geqq Ns$, it is assumed that the problem of pressure interference does not occur, so that the process proceeds to Step S4 to set the straight travel valve 25 to the intermediate position B.

This opens the connection path 27 to send a portion of the oil discharged from the first pump 19 towards the travel side, thereby preventing a sudden reduction in travel speed.

In contrast, if $Nr < Ns$ in Step S3, it is assumed that pressure interference may occur. Therefore, the position of the straight travel valve 25 is switched to the straight travel position C.

In this case, the controlling device is actually formed so that the output of the straight travel proportional valve 23 changes proportionally to the operation amount of the working actuators (secondary pressures of the remote control valves), so that the straight travel valve 25 performs a stroke in accordance with the output of the proportional valve 23. Therefore, how the output of the proportional valve changes with respect to the operation amount (or the inclination of this change with respect to the operation amount) is changed in accordance with whether the engine rotational speed Nr is equal to or greater than or is less than the set rotational speed Ns.

Figure 3:
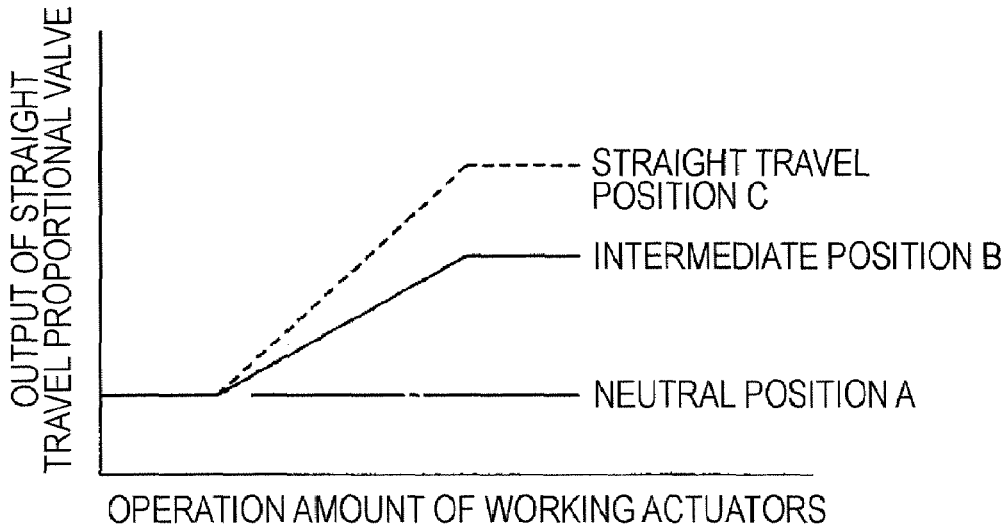
FIG. 3 is a graph showing the relationship between operation amount of working actuators and output of a straight travel proportional valve in the hydraulic controlling device.

FIG. 3 is a graph showing the relationship between the operation amount of the working actuators and the output of the straight travel proportional valve (that is, the stroke of the straight travel valve 25). When the engine rotational speed Nr is equal to or greater than the set rotational speed Ns, as shown by a solid line, the output of the proportional valve increases as the operation amount increases so that the straight travel valve 25 performs a stroke up to the intermediate position B at a maximum (that is, the opening amount of the connection path 27 is a maximum).

In contrast, when the engine rotational speed Nr is less than the set rotational speed Ns, as shown by a broken line, the output of the proportional valve increases as the operation amount increases so that the straight travel valve 25 performs a stroke up to the straight travel position C at a maximum (that is, the opening amount of the connection path 27 is 0).

This controlling operation narrows the connection path 27 (whose minimum opening amount is 0) when the engine rotational speed Nr is less than the set rotational speed Ns. Therefore, the problem of the movement of the working actuators under high operating pressure (such as the raising of the boom) becoming very sluggish or stopping during a combined operational process will not occur. In other words, it is possible to reliably prevent pressure interference in a state in which the rotational speed of the engine is low.

In addition, since the opening is controlled when the rotational speed Nr of the engine becomes less than the set rotational speed Ns, if the set rotational speed is set at a rotational speed value at which pressure interference starts to occur when performing a combined operational process, it is possible to ensure its primary function (smooth travel) due to the provision of the connection path 27, at a rotational speed that is equal to or greater than the set rotational speed.

Further, since the opening amount of the connection path 27 of the straight travel valve 25 itself is controlled by controlling the position of the straight travel valve 25, compared to, for example, a structure in which an opening of an externally provided communication valve is controlled, costs are reduced and less space is used.

Figure 4:
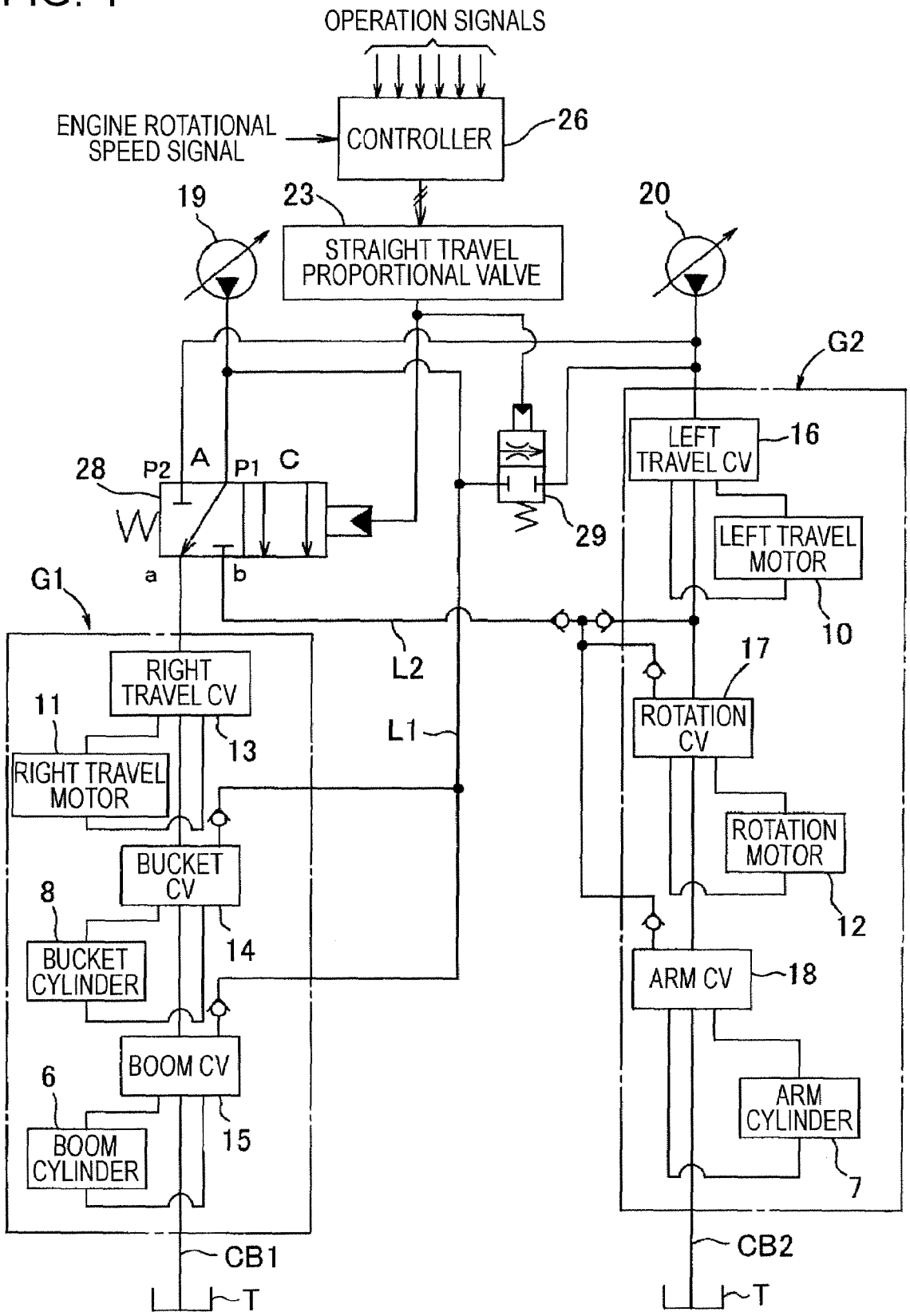
FIG. 4 shows an entire structure of a hydraulic controlling device according to another embodiment of the present invention.
Figure 5:
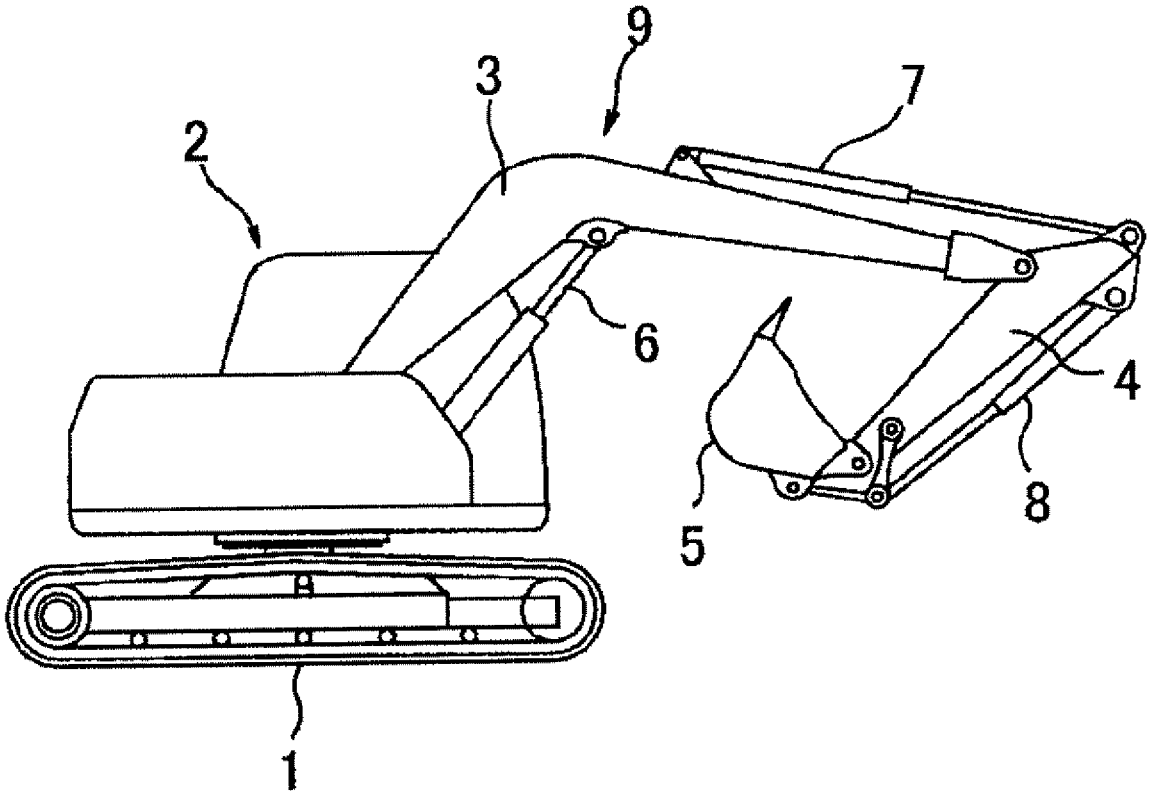
FIG. 5 is a schematic side view of a hydraulic excavator.

A structure of a hydraulic controlling device according to another embodiment of the present invention is shown in FIG. 4. In this structure, a straight travel valve 28 operates so that its position is switched between a neutral position A and a straight travel position C, and a communication valve 29 that connects/disconnects pump lines to/from each other is provided outside the straight travel valve 28. An opening amount of the communication valve 29 is controlled in accordance with an engine rotational speed when performing a combined operational process as in the first embodiment.

Even this structure makes it possible to achieve the object of preventing pressure interference in a state in which the engine rotational speed is low when performing a combined operational process.

Although, in the above-described embodiments, an opening controlling operation for reducing the opening amount of the connection path is performed when the engine rotational speed Nr is less than the set rotational speed Ns, the opening amount of the connection path may be gradually reduced proportionally to a reduction in the rotational speed of the engine.

In this case, the controlling operation of gradually reducing the opening amount may be carried out over an entire rotational speed area or only in a rotational speed area that is equal to or less than a certain rotational speed.

Although the invention has been described with reference to the preferred embodiments in the attached figures, it is noted that equivalents may be employed and substitutions made herein without departing from the scope of the invention as recited in the claims.

What is claimed is:

1. A hydraulic controlling device of a working machine, comprising:

a lower traveling body;

an upper rotating body mounted on the lower traveling body;

a working attachment mounted to the upper rotating body;

hydraulic actuator groups including left and right travel motors and working actuators that are actuators other than the left and right travel motors, the hydraulic actuator groups being divided into a first group and a second group, the first group including one of the left and right travel motors, the second group including the other of the left and right travel motors;

first and second pumps serving as hydraulic sources that are driven by an engine; and a straight travel valve adapted to switch flow paths of oil discharged from the pumps, wherein, when performing a single operational process in which a travel operation and a working operation, which is an operation other than the travel operation, are performed separately, the straight travel valve is at a neutral position and supplies the oil discharged from the separate pumps to the first and second groups, wherein, when performing a combined operational process in which the travel operation and the working operation are performed at the same time, the position of the straight travel valve is switched to a straight travel position and the straight travel valve supplies the oil discharged from the separate pumps to both of the travel motors and the working actuators, wherein, when the neutral position of the straight travel valve is switched to the straight travel position, pump lines of both of the pumps are connected to each other by a connection path, and wherein the hydraulic controlling device further comprises controlling means for performing an opening controlling operation that reduces an opening amount of the connection path at a low-rotational-speed side in accordance with a rotational speed of the engine when performing the combined operational process.

2. The hydraulic controlling device of the working machine according to claim 1, wherein the straight travel valve has an intermediate position that is disposed in the connection path and that is situated between the neutral position and the straight travel position, and the controlling means performs the opening controlling operation by controlling the position of the straight travel valve.

3. The hydraulic controlling device of the working machine according to claim 1, further comprising a communication valve that is disposed outside the straight travel valve, wherein the controlling means performs the opening controlling operation with the communication valve serving as the connection path.

4. The hydraulic controlling device of the working machine according to claim 1, wherein the controlling means performs the opening controlling operation when the rotational speed of the engine is less than a set rotational speed.

* * * * *